US008109799B2

(12) United States Patent
Schlipf

(10) Patent No.: US 8,109,799 B2
(45) Date of Patent: Feb. 7, 2012

(54) HIGH-TEMPERATURE PATCH PLUG FOR CONNECTION LINES

(75) Inventor: Andreas Schlipf, Tuttlingen (DE)

(73) Assignee: Türk & Hillinger GmbH, Tuttlingen (DE)

( * ) Notice: Subject to any disclaimer, the term of this patent is extended or adjusted under 35 U.S.C. 154(b) by 0 days.

(21) Appl. No.: 12/873,505

(22) Filed: Sep. 1, 2010

(65) Prior Publication Data

US 2011/0053433 A1 Mar. 3, 2011

(30) Foreign Application Priority Data

Sep. 2, 2009 (DE) ..... 20 2009 011 857 U

(51) Int. Cl.
*H01R 13/514* (2006.01)

(52) U.S. Cl. ..... 439/736; 439/936

(58) Field of Classification Search ..... 439/736, 439/936

See application file for complete search history.

(56) References Cited

U.S. PATENT DOCUMENTS 5,409,404 A 4/1995 Reed
5,836,792 A 11/1998 Thumma et al.
7,534,139 B2 * 5/2009 Andre et al. ..... 439/587

* cited by examiner

*Primary Examiner* — Gary F. Paumen
(74) *Attorney, Agent, or Firm* — McGlew and Tuttle, P.C.

(57) ABSTRACT

A high-temperature patch plug (50) for one or more connection lines (60), especially for connecting electric supply and/or signal lines to heating elements and/or thermocouples or temperature sensors. The patch plug (50) has one or more poles each with a contact element (64) connected to an inner conductor (61) of a connection line (60), and with a one-piece, insulating housing (51), which surrounds an interior (59), in which at least the at least one contact element (64) is accommodated at least partially. The housing (51) has at least one insertion opening (63) on the side facing away from the plugging side and a passage opening (57), which is connected to the insertion opening via the interior (59) of housing (51) for each pole on the side facing the plugging side. The contact element (64) is locked in the housing (51) for each pole at a locking step (53) arranged in the interior of the housing such that a motion of the contact element (64) against the plugging direction is limited by the locking, wherein said locking step (53) is formed by an irreversible deformation of housing.

21 Claims, 2 Drawing Sheets

HIGH-TEMPERATURE PATCH PLUG FOR CONNECTION LINES

CROSS REFERENCE TO RELATED APPLICATIONS

This application claims the benefit of priority under 35 U.S.C. §119 of German Patent Application DE 20 2009 011 857.6 filed Sep. 2, 2009, the entire contents of which are incorporated herein by reference.

FIELD OF THE INVENTION

The present invention pertains to a high-temperature patch plug for connection lines, as it is used especially for connecting electric supply and/or signal lines to heating elements and/or thermocouples or temperature sensors.

BACKGROUND OF THE INVENTION

A plurality of patch plugs, in which electric connection lines are connected to an insulating, one-piece housing with a contact element accommodated in said housing, are already known. The housings are manufactured, as a rule, from a plastic, injection molding processes being used in many cases.

However, such patch plugs do not, as a rule, meet the special requirements that are associated with high-temperature applications, in which the plugs are exposed to a thermal load of 120° C. and higher. Only a few of the electrically insulating materials that can be used for insulating patch plug housings are sufficiently resistant to such a thermal load. However, the possibility of making it possible to manufacture a housing with a desired design especially according to the injection molding process by adapting the material use is thus eliminated as well. This problem becomes even more acute as the desired designs become ever more compact.

Usual high-temperature patch plugs are designed for this reason, as a rule, such that a connection is established in them for every individual pole between a contact element and a conductor and the corresponding connection is then surrounded, especially after the plug thus prepared has been combined with a counterplug, with a housing made of PEEK or a heat-shrinkable sleeve, which said housing is coordinated with the conductor cross section and the external diameter of the individual conductor and is crimped with same and is thus thermally and electrically insulated. Such high-temperature plugs are available, e.g., from Electrolux under the name "high-temperature plug-in connection HTC."

The drawback of this embodiment is that the manufacture of a plug-in connection is associated with a relatively great effort. Furthermore, the space requirement is relatively high, especially for multipole high-temperature plug-in connections, which are based in these plugs.

SUMMARY OF THE INVENTION

The object of the present invention is therefore to make available a high-temperature patch plug for connection lines, especially for connecting heating elements and/or thermocouples, as well as temperature sensors, which is compact and can be manufactured in a favorable manner.

The high-temperature patch plug according to the present invention for connection lines, especially for connecting electric supply and/or signal lines to heating elements and/or thermocouples or temperature sensors, has one pole or a plurality of poles. The poles comprise each a contact element connected to an inner conductor of a connection line.

The high-temperature patch plug has, furthermore, a one-piece, insulating housing, which encloses an interior, in which at least the at least one contact element is partially accommodated. On the side facing away from the plugging side, the housing has at least one insertion opening for inserting the pole and, on the side facing the plugging side, a passage opening for each pole. The passage openings are in connection with the insertion opening via the interior of the housing. They are used especially to pass through pins of a male contact element of the high-temperature patch plug or of the corresponding counterplug, but it is, in principle, also possible to pass female connection parts of the contact element through them. The contact element is locked into the housing for each pole at a locking step arranged in the interior of the housing such that a motion of the contact element against the plugging direction is limited by the locking. The locking step is formed here by an irreversible deformation of the housing; at the site at which the locking step is arranged, the outer wall of the housing is pressed in in the direction of the interior of the housing in the finished high-temperature patch plug even without the action of external forces. A housing with a locking step embodied in this manner can be manufactured in an especially simple and favorable manner.

Especially preferred is an embodiment of the present invention in which the locking step belonging to a particular pole is designed such that relative to a parallel to the plugging direction, which passes through the center of the passage opening for said pole, the distance between a surface of the particular locking step, which said surface faces said parallel, and said parallel is greater than the shortest distance between a point of a wall of the respective passage opening and said parallel. As an alternative, this feature can be embodied by the respective locking step being lower than the highest point of the wall of the corresponding passage opening, which extends in the same direction as the locking step.

An advantageous consequence of this geometric embodiment of the housing is that a contact element, which is pushed in through the insertion opening and whose motion against the plugging direction is limited by the locking step after the locking, is also limited by the wall of the passage opening in terms of a motion in the plugging direction. It thus becomes possible to ensure the fixation of the contact element in the housing by a single locking alone, which leads to a simple and compact design.

Provisions are made in an advantageous embodiment of the present invention for the contact element or contact elements to be locked at a surface of the locking step, the surface being at an end surface of a duct, which extends from the locking step in the plug-side direction to the plug-side housing wall and is open in the direction of the interior. Separation of the locked parts is possible in this geometric embodiment. This can be brought about in an especially simple manner if the duct or ducts has/have a duct opening, which passes through the plug-side wall of the housing. This makes it possible to insert a tool to release the locking connection in a simple manner.

A high-temperature-resistant plastic with a long-term temperature stability of >200° C., especially FEK (polyether ketones), PFA (perfluoroalkoxoethylene), FEP (perfluoroethylenepropylene) or VESPEL (a polyimide), is an especially suitable material for the housing because of its good thermal deformability.

To avoid a possible electric interaction between the poles, it is advantageous, if the high-temperature patch plug has more than one pole, if the interior of the housing has partitions, which separate the contact elements of the respective poles from one another. In particular, each pole may be accommodated in a separate chamber each of the interior, which connects a corresponding insertion opening and the corresponding passage opening with one another.

To secure a plug-in connection established by means of the high-temperature patch plug, it is advantageous to arrange at least one burr, at least one detent or at least one depression on at least one surface of the housing to lock the housing with a counterplug. This may happen, for example, according to a locking principle or according to the principle of a bayonet catch.

A material for the contact elements, which is especially suitable for high-temperature application, is steel, especially spring steel. The locking of the contact elements is brought about preferably with a stop spring provided on these. If the contact elements are designed as clamping bushings, it is possible to generate high contact pressures, which are especially important in case of high-temperature applications, between the bushing and the corresponding male contact element of the counterplug, which contact element is inserted into the bushing through the corresponding passage openings. Furthermore, it is ensured, if the contact element of the high-temperature patch plug for connection lines is designed as a bushing, that any voltages that may still be present on the connection lines are present only within the insulating housing, whereas open contacts, which are live, may be present in case of an embodiment as a contact pin projecting from the housing, which is, of course, in principle, possible.

The high-temperature patch plug can be manufactured in an especially simple manner if the irreversible deformation of the housing to form the locking step is carried out by thermal and/or mechanical deformation during the manufacture.

An especially tight embodiment, which can effectively prevent, e.g., the penetration of moisture, is obtained if the insertion opening or, in case of a plurality of poles, the insertion openings of the housing are sealed with a cement, a molding made of silicone or plastic or a pourable sealing compound. This effect can be extended to a plug-in connection with a counterplug extending fully or partially over the high-temperature patch plug if the high-temperature patch plug or the housing thereof is surrounded with a sealing element. This may be concretely an O-ring, which is inserted into a groove extending at right angles to the plugging direction through the housing.

The present invention will be explained in more detail on the basis of drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
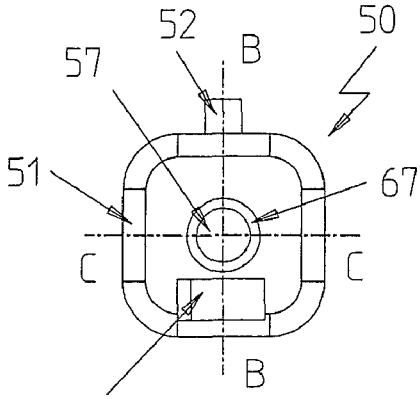
FIG. 1*a* is a view of a single-pole exemplary embodiment of the high-temperature patch plug showing the plugging side viewed in the plugging direction.

Referring to the drawings in particular, identical reference numbers are used for identical components of the same exemplary embodiments in all figures, unless mentioned otherwise.

FIG. 1*a* shows the view of a single-pole exemplary embodiment of a high-temperature patch plug 50, viewed against the plugging direction. A housing 51 with a detent 52 is recognized. The plug-side boundary surface of housing 51 is passed through by a passage opening 57, which is limited by a double circle because of a wall 67 beveled as an insertion aid, and by a duct opening 65. Lines B-B and C-C represent section lines, which illustrate the perspective of the views in FIGS. 2 and 3, from which the design of the high-temperature patch plug 50 appears even more clearly.

Figure 1C:
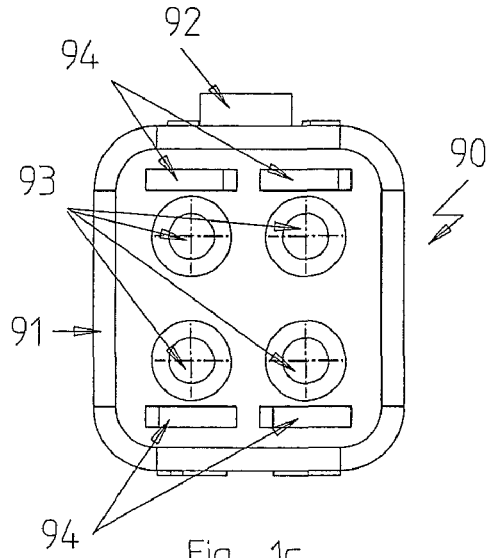
FIG. 1*c* is the view of a four-pole exemplary embodiment of the high-temperature patch plug showing the plugging side viewed in the plugging direction.
Figure 1B:
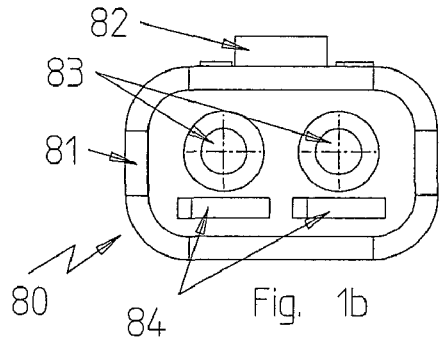
FIG. 1*b* is the view of a two-pole exemplary embodiment of the high-temperature patch plug showing the plugging side viewed in the plugging direction.

FIG. 1*b* shows the same view of a two-pole high-temperature patch plug. A housing 81 with a detent 82 is recognized. The plug-side boundary surface of housing 81 is passed through in this embodiment by two passage openings 83 and by two duct openings 84. The passage openings 84 are arranged next to each other and each above the corresponding duct openings 84. The arrangements of the passage openings 83 and duct openings 84 are, in principle, freely selectable as desired, but it is advantageous to arrange the duct openings 84 between a wall of housing 81 and the passage openings 83 associated with the respective duct openings, because this contributes to a more compact design.

FIG. 1*c* shows the same view of a four-pole high-temperature patch plug. A housing 91 with a detent 92 is recognized. The plug-side boundary surface of housing 91 is passed through in this embodiment by four passage openings 93 and by four duct openings 94. The passage openings 93 are arranged each next to each other, and the corresponding duct openings 94 are arranged each between the passage openings 93 and a wall of housing 91.

Figure 2:
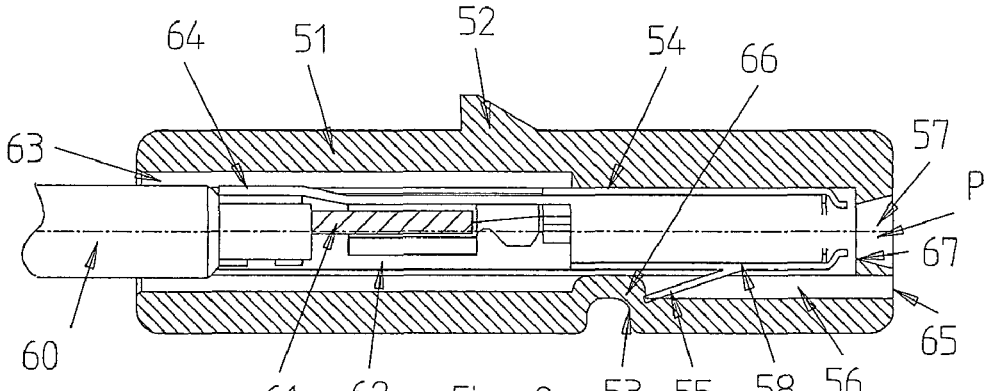
FIG. 2 is a sectional view of the exemplary embodiment from FIG. 1*a*, cut along line B-B.

FIG. 2 shows a sectional view of the exemplary embodiment from FIG. 1*a*, cut along line B-B.

Figure 4B:
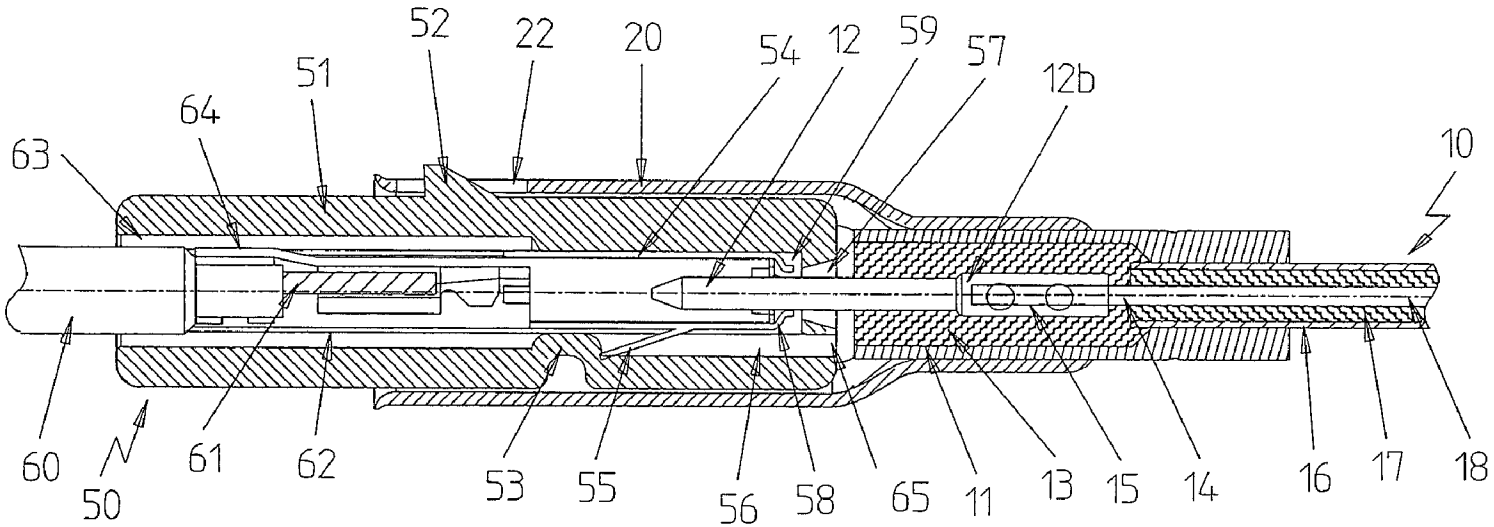
FIG. 4*b* is the plug-in connection from FIG. 4*a*, cut along line A-A.

The high-temperature patch plug 50 has a housing 51 made in one piece, which preferably consists of a ceramic or a high-temperature-resistant plastic. Housing 51 has, furthermore, a detent 52, which can be locked, as is shown in FIG. 4*b*, with a recess 22 in a tongue 21 of a second sleeve 20 of a counterplug 10 in order to prevent unintended separation of the plug-in connection.

Housing 51 has, furthermore, on the plugging side, a passage opening 57 with a wall 67 beveled as an insertion aid and a duct opening 65 and, on the side located opposite the plugging side, an insertion opening 63. Passage opening 57 and insertion opening 63 are connected to one another via an interior 59 of housing 51. The duct opening 65 is likewise connected to the interior 59 via a duct 56, which extends in parallel to the plugging direction and is open towards the interior 59. A deformation of the housing 51 forms a locking step 53, whose plugging side forms the end surface of duct 56, which said end surface faces away from the plugging side. A contact element 64, which can be pushed in through the insertion opening 63 and is designed here as a clamping bushing with clamping legs 54, 58 and with a mounting area 62 and preferably consists of steel, especially spring steel, is inserted into the interior 59. As is apparent from FIG. 3, contact element 64 has two more clamping legs 68, 69, which cannot be recognized in the view shown in FIG. 2. A stop spring 55, which is locked with locking step 53, is arranged at clamping leg 58.

An advantageous embodiment of the present invention can be illustrated once again on the basis of the view shown in FIG. 2: This figure shows a straight line P, which extends in parallel to the plugging direction through the center of passage opening 57. The surface 66 of the locking step 53 facing the straight line P is at a greater distance in this exemplary embodiment from this straight line than the distance between a point of wall 67 of the passage opening 57 and the parallel P. The locking step 53 is thus lower than the part of the wall 67 of the passage opening 57, which part is oriented in the same direction.

It is achieved due to this geometric relationship that even though contact element 64 can be pushed in the plugging direction over the locking step 53 until it becomes locked, it cannot be pushed out of the housing 51. In particular, nearly clearance-free seating of the locked contact element 64 can be achieved in case of corresponding adaptation of the length ratios between housing 51 and the length of the clamping legs 54, 58 and the arrangement of the position of stop spring 55 at the clamping leg 58.

The embodiment of housing 51 shown with plug-side duct opening 65 and duct 56 can be manufactured in a simple, cost-effective and novel manner with the use of injection molding techniques. The housing 51 is manufactured at first and the housing is then deformed, with the contact element 64 inserted and already connected to an inner conductor 61 of a connection line 60, at a point at which the locking step 53 is to be prepared. A preferred possibility for this is, for example, a local thermal deformation. To obtain a secure and reliable high-temperature patch plug 50, it is desirable to avoid breaking through the housing 51 at right angles to the plugging direction; the use of a punch working in this direction is therefore ruled out during the manufacture for preparing the locking step 53.

As is shown in FIG. 4*b*, a contact element 12 of the counterplug 10, which said contact element is designed as a contact pin, can be clamped between the clamping legs 54, 58 and the other two clamping legs 68, 69, which cannot be recognized in this sectional view. A reliable electrical and mechanical contact is ensured between the respective contact elements 12, 64 due to the high pressure of the clamping legs, which is made possible by the use of steel as the material for the contact elements even at high temperatures.

An electric contact with an exposed inner conductor 61 of a connection line 60, which is inserted over a certain section into the housing 51 through the insertion opening 63, is made in the receiving area 62 of the contact element 64.

A preferred embodiment of a multipole high-temperature patch plug is obtained, in principle, by arranging the desired number of single-pole patch plugs, which is achieved such that detents 52 of the single-pole patch plugs always point in the direction of an outer wall of the resulting plug housing 51.

The inner walls between the individual single-pole assembly units or cells of the resulting multipole high-temperature patch plug are now made preferably thinner.

Figure 3:
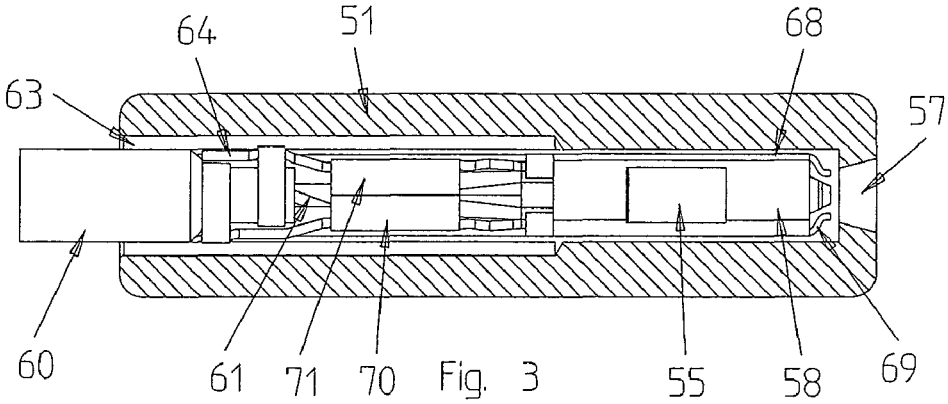
FIG. 3 is another sectional view of the exemplary embodiment from FIG. 1*a*, cut along line C-C.

FIG. 3 shows another sectional view of the exemplary embodiment from FIG. 1*a*, cut along line C-C. The design, which appears from FIG. 3, fully corresponds to the design described in detail on the basis of FIG. 2; reference is explicitly made to the description of FIG. 2 to avoid repetitions and only the further recognizable details will be dealt with. Metal strips 70, 71, which are arranged in the connection area 62 of contact element 64 and are pressed onto the inner conductor 61 to fix same, can be recognized especially clearly in this section. Furthermore, the two clamping legs 68, 69, which are not visible in FIG. 2, can be recognized in this section. It also becomes clear that stop spring 55 is formed by a material strip of the clamping leg 58 here.

Figure 4A:
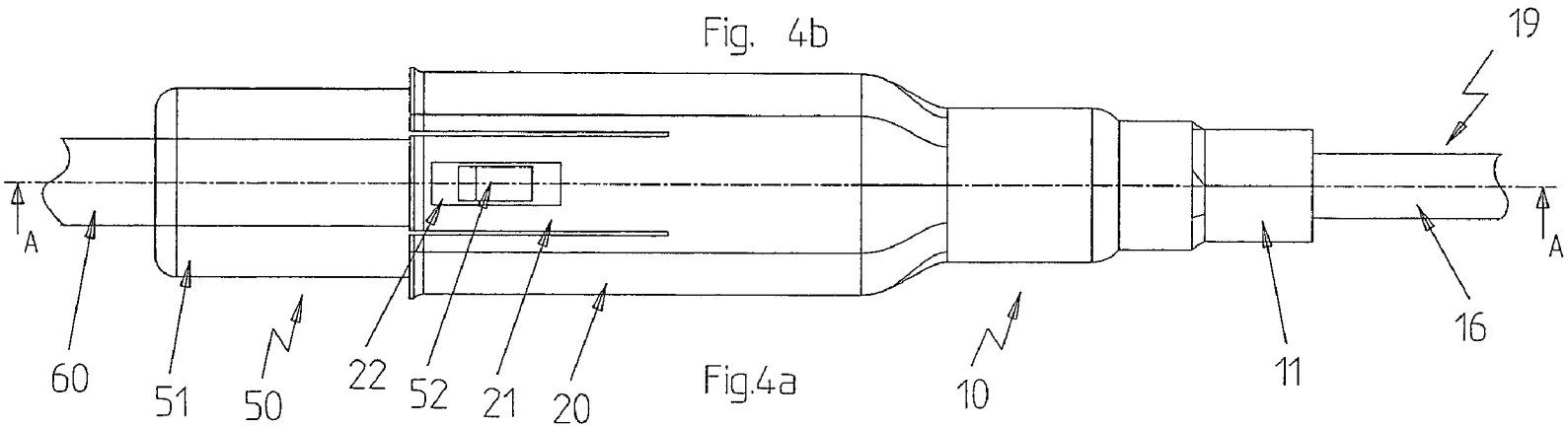
FIG. 4*a* is the view of a plug-in connection manufactured with the use of the high-temperature patch plug shown in FIGS. 1*a*, 2 and 3 with a counterplug, viewed at right angles to the plugging direction.

FIG. 4*a* shows the view of a novel plug-in connection manufactured with the use of the high-temperature patch plug shown in FIGS. 1 through 3 with a counterplug 10, viewed at right angles to the plugging direction. Only the metal jacket 16 of the metal-jacketed connection line 19, the connection sleeve 11 and the second sleeve 20 with tongue 21 and recess 22 are recognized from the counterplug 10 in this view. A connection line 60, a part of a housing 51, over which part of the second sleeve 20 does not extend, and a detent 52, which is arranged at housing 51 and meshes with the recess 22, can be recognized from the high-temperature patch plug 50. Details of the design can be found from the sectional view along line A-A, which is shown as FIG. 4*b*.

The view of the high-temperature patch plug 50, which is shown in FIG. 4*b*, is exactly identical to the view shown in FIG. 2. Reference is therefore made for its design to the description of FIG. 2.

Concerning the design of the counterplug 10, FIG. 4*b* shows a metal-jacketed connection line 19, comprising a wire section 18, which is surrounded at right angles to its first direction of extension by an insulating embedding 17 and a metal jacket 16. A wire end 14 projects in the plugging direction from the front surface of the metal-jacketed connection line 19.

The end section of the metal-jacketed connection line 19 is surrounded at right angles to the first direction of extension of the metal-jacketed connection line 19 by a connection sleeve 11 made of metal, which is firmly connected to the metal jacket 16. Connection sleeve 11 extends in the plugging direction beyond the end of the metal jacketed connection line 19.

Wire end 14 is in contact in a contact area 15 with a contact element 12, which is designed here as a contact pin with a hole, which is, however, not visible in FIG. 2 because it is filled by the plug-side end section of the wire end 14. Contact element 12 projects over the connection sleeve 11 in the plug-side direction. The space area between contact element 12 or the wire end 14 and the part of the connection sleeve 11, which part extends beyond the end of the metal-jacketed connection line 19 in the plugging direction, is filled with a ceramic insulating mass 13. A filling with a metal oxide would be just as suitable. The exact positioning of the contact element 12 is fixed, on the one hand, and the thermal and electric insulation from the connection sleeve 11 is ensured, on the other hand, by the filling. Not only the contact area 15, but other areas of the wire end 14 and of the contact element 12 are also embedded in the ceramic insulating mass in the exemplary embodiment being shown, which makes the manufacture of the counterplug 10 especially simple.

At a plug-side section of the connection sleeve 11, a second sleeve 20 made of metal, which extends in the plugging direction both beyond the connection sleeve 11 and the plug-side end of the contact element 12, is fastened in the direction extending at right angles to the plugging direction, surrounding said connection sleeve 11. Even though a strong holding force is exerted between the high-temperature patch plug 50 and the counterplug 10 even at high temperature especially if contact elements made of steel are used, securing the plug-in connection by means of the second sleeve 20 is advantageous. This is made possible by the fact that a section of the wall of the second sleeve 20, which said section is not in contact with the connection sleeve 11, is designed as a tongue 21, which has a recess 22. As will be described in more detail below on the basis of FIGS. 4*a* and 4*b*, a locking connection is made hereby possible between the high-temperature patch plug 50 and the counterplug 10. The plug-side edge of the second sleeve 20 is advantageously bent slightly to the outside, i.e., in the direction at right angles to the plugging direction in order to form an insertion aid for the high-temperature patch plug 50.

This novel combination of counterplug 10 and high-temperature patch plug 50 makes possible a hitherto unknown, very simple and comfortable procedure in manufacturing the plug-in connection. After the counterplug 10 has been supplied, only a section of the inner conductor 61 must be exposed at the plug-side end of the connection line 60, which said section is then brought, e.g., by crimping or soldering, into electric contact with the contact element 64 of the counterplug. The connection line thus connected to the contact element 64 must then only be pushed in through the insertion opening 63 of housing 51 until stop spring 55 locks with the locking step 53. The contact element 64 of counterplug 50 is thus fixed between the locking step 53 and the plug-side wall of housing 51 and the high-temperature patch plug is assembled completely. To finish the plug-in connection, only the housing 51 must be pushed into the second sleeve 20 of the counterplug 10 until the detent 52 locks into recess 22. Contact element 12 of the counterplug 10 is now brought at the same time into electric connection with contact element 64 of the high-temperature patch plug 50.

Separation of the plug-in connection is just as simple. Tongue 21 of the counter plug 10 is raised for this, e.g., by means of a screwdriver, so that the detent 52 is released. The counterplug 10 and the high-temperature patch plug 50 can then be pulled apart. It is possible in the same manner to push back the stop spring 55 of the contact element 64 by inserting a correspondingly shaped object through the duct opening 65 into the duct 56 and to make it possible hereby to pull out the contact element 64.

While specific embodiments of the invention have been described in detail to illustrate the application of the principles of the invention, it will be understood that the invention may be embodied otherwise without departing from such principles.

APPENDIX

List of Reference Numbers

10 Counterplug
11 Connection sleeve
12, 64 Contact element
12*b* Square section
13 Ceramic insulating mass
14 Wire end
15 Contact area
16 Metal jacket
17 Insulating embedding
18 Wire section
19 Metal-jacketed connection line
20 Second sleeve
21 Tongue
22 Recess
50, 80, 90 High-temperature patch plug
51, 81, 91 Housing
52 Detent
53 Locking step
54, 58, 68, 69 Clamping leg
55 Stop spring
56 Duct
57, 83, 93 Passage opening
59 Interior
60 Connection line
61 Inner conductor
62 Mounting area
63 Insertion opening
65, 84, 94 Duct opening
66 Surface of locking step
67 Wall
70, 71 Metal strip
P Parallel to the plugging direction extending through the center of an insertion opening

What is claimed is:

1. A high-temperature patch plug for one or more connection lines for connecting electric supply and/or signal lines to heating elements and/or thermocouples or temperature sensors, the high-temperature patch plug comprising:

one or more poles, each of the or more poles comprising a contact element connected to an inner conductor of a connection line;

a one-piece insulating housing defining an interior, the at least one contact element being accommodated at least partly in the interior, the housing having a plugging side and at least one insertion opening on a side facing away from the plugging side and has a passage opening for each pole on the side facing the plugging side, said plugging side comprising a counterplug contact opening for receiving a counterplug contact, each passage opening being connected to the respective insertion opening via the interior of housing, wherein the contact element, for each pole, is in a locking state in the housing via a locking step arranged in the interior of the housing such that a motion of the contact element in a direction opposite to the plugging direction is limited by the locking, the locking step being formed by an irreversible deformation of the housing.

2. A high-temperature patch plug in accordance with claim 1, wherein in respect to a central parallel direction to the plugging direction, which extends through the center of the respective passage opening, the distance between a surface of the respective locking step, which said surface faces the central parallel, and the central parallel is greater than the shortest distance between a point of a wall of the respective passage opening and the central parallel.

3. A high-temperature patch plug in accordance with claim 1, wherein the contact element or contact elements is/are locked on a surface of the locking step forming an end surface of a duct, which extends from the locking step in the plug-side direction to the plug-side housing wall and is open in the direction of the interior.

4. A high-temperature patch plug in accordance with claim 3, wherein the duct or ducts has/have a duct opening passing through the plug-side wall of the housing.

5. A high-temperature patch plug in accordance with claim 1, wherein:

the material of the housing is a high-temperature-resistant plastic with a long-term temperature stability of greater than 200° C.

6. A high-temperature patch plug in accordance with claim 1, wherein:

the one or more poles comprise more than one pole; and the interior of the housing has partitions, which separate the contact elements of the respective poles from one another.

7. A high-temperature patch plug in accordance with claim 1, wherein at least one burr, at least one detent or at least one depression is arranged on at least one exterior surface of the housing for locking the housing with a counterplug.

8. A high-temperature patch plug in accordance with claim 1, wherein the contact element or contact elements is/are made of steel.

9. A high-temperature patch plug in accordance with claim 1, wherein the contact element or contact elements has/have a stop spring.

10. A high-temperature patch plug in accordance with claim 1, wherein the contact elements are designed as clamping bushings.

11. A high-temperature patch plug in accordance with claim 1, wherein the insertion opening or insertion openings of the housing are sealed with a cement, with a molding made of plastic silicone, which is pressed in, or with a pourable sealing compound.

12. A high-temperature patch plug in accordance with claim 1, wherein the irreversible deformation of the housing was carried out by thermal and/or mechanical deformation.

13. A high-temperature patch plug in accordance with claim 1, wherein the housing is surrounded with a sealing element.

14. A high-temperature patch plug in accordance with claim 5, wherein the material of the housing is at least one of PEEK, PFA, FEP or VISPEL.

15. A high-temperature patch plug for connecting electric supply and/or signal lines to heating elements and/or thermocouples or temperature sensors, the high-temperature patch plug comprising:

a connection line with an inner conductor;

a one-piece insulating housing defining an interior, the housing having a plug insertion side with a counterplug contact passage opening for receiving a counterplug contact and with an opposite insertion opening on a side facing away from the plug insertion side, the passage opening being connected to the insertion opening, in an axial direction, via the interior, the housing including a locking step extending into the interior, the locking step being formed by an irreversible deformation of the housing; and a pole comprising a contact element connected to the inner conductor of the connection line, the contact element being accommodated at least partly in the interior and interacting with the locking step to provide locking for limiting motion of the contact element in the axial direction.

16. A high-temperature patch plug in accordance with claim 15, wherein an axial center line, extending in the axial through the center of the respective passage opening, is spaced from the locking step more than the shortest distance from a wall surface of the passage opening and the axial center line.

17. A high-temperature patch plug in accordance with claim 16, wherein the contact element is locked on a surface of the locking step to form an end surface of a duct, which duct extends from the locking step to the plug-side housing wall and is open in the direction of the interior.

18. A high-temperature patch plug in accordance with claim 17, wherein the duct or ducts has/have a duct opening passing through the plug-side wall of the housing.

19. A high-temperature patch plug in accordance with claim 16, wherein:

the material of the housing is a high-temperature-resistant plastic with a long-term temperature stability of greater than 200° C.

20. A high-temperature patch plug in accordance with claim 15, wherein the one-piece insulating housing defining the interior includes partitions to define pole regions each having a plug insertion side with a counterplug contact passage opening for receiving a counterplug contact and with an opposite insertion opening on a side facing away from the plug insertion side, each passage opening being connected to each respective insertion opening, in an axial direction, via the respective pole region of the interior, each pole region including a locking step extending into the interior, each locking step being formed by an irreversible deformation of the housing and further comprising:

additional poles each with a contact element connected to a respective inner conductor of a respective connection line, each contact element being accommodated at least partly in the interior and interacting with the respective locking step to provide locking for limiting motion of each contact element in the axial direction.

21. A high-temperature patch plug for connecting electric supply and/or signal lines to heating elements and/or thermocouples or temperature sensors, the high-temperature patch plug comprising:

a counterplug comprising a counterplug contact;

a connection line with an inner conductor;

a one-piece insulating housing defining an interior, the housing having a plug insertion side with a counterplug contact passage opening and with an opposite insertion opening on a side facing away from the plug insertion side, said insertion opening receiving at least a portion of said connection line, said counterplug contact passage opening receiving at least a portion of said counterplug contact, said counterplug contact passage opening being connected to the insertion opening, in an axial direction, via the interior, the housing including a locking step extending into the interior, the locking step being formed by an irreversible deformation of the housing; and a pole comprising a contact element connected to the inner conductor of the connection line, the contact element being accommodated at least partly in the interior and interacting with the locking step to provide locking for limiting motion of the contact element in the axial direction.

* * * * *